US008029093B2

(12) United States Patent
Love

(10) Patent No.: US 8,029,093 B2
(45) Date of Patent: Oct. 4, 2011

(54) OVERPRINT TROUGH FOR AN IMAGE FORMING APPARATUS

(75) Inventor: John C. Love, San Diego, CA (US)

(73) Assignee: Eastman Kodak Company, Rochester, NY (US)

( * ) Notice: Subject to any disclaimer, the term of this patent is extended or adjusted under 35 U.S.C. 154(b) by 479 days.

(21) Appl. No.: 12/177,381

(22) Filed: Jul. 22, 2008

(65) Prior Publication Data

US 2010/0020127 A1 Jan. 28, 2010

(51) Int. Cl.
*B41J 2/165* (2006.01)

(52) U.S. Cl. ..... 347/34; 347/20; 347/22; 347/36; 347/101; 347/104

(58) Field of Classification Search ..... 347/20, 347/22, 34, 36, 101, 104
See application file for complete search history.

(56) References Cited

U.S. PATENT DOCUMENTS 6,270,074 B1 8/2001 Rasmussen et al.
6,478,492 B1 * 11/2002 Crystal ..... 400/656
6,575,554 B2 * 6/2003 Yoshinaga ..... 347/22
6,679,602 B1 1/2004 Bruhn
6,783,206 B2 * 8/2004 Bruhn et al. ..... 347/34
6,927,841 B2 8/2005 Hinojosa et al.
6,957,887 B2 10/2005 Bruhn
7,712,865 B2 * 5/2010 Ishii et al. ..... 347/31
7,731,349 B2 * 6/2010 Hatasa et al. ..... 347/104
2003/0085980 A1 * 5/2003 Ishii et al. ..... 347/104
2004/0085389 A1 * 5/2004 Smith et al. ..... 347/34
2008/0174652 A1 * 7/2008 Schmid ..... 347/104

OTHER PUBLICATIONS

Love, John C., "Vacuum Platen for an Image Forming Apparatus", U.S. Appl. No. 12/177,432.
Love, John C., "Cutting Station for an Image Forming Apparatus", U.S. Appl. No. 12/177,349.

* cited by examiner

*Primary Examiner* — Ryan Lepisto
(74) *Attorney, Agent, or Firm* — William R. Zimmerli

(57) ABSTRACT

An image forming apparatus includes a reference surface that is partitioned into an array of chambers; an image forming head for forming an image on a media; and a source of negative pressure. The array of chambers is in fluid communication with the source of negative pressure. An overprint trough is positioned neighboring the array of chambers. The overprint trough includes a side wall with a plurality of vent holes to direct airborne ink mist produced by the image forming head away from a back side of the media.

18 Claims, 8 Drawing Sheets

OVERPRINT TROUGH FOR AN IMAGE FORMING APPARATUS

CROSS REFERENCE TO RELATED APPLICATIONS

Reference is made to commonly assigned U.S. patent application Ser. No. 12/177,432 filed concurrently herewith entitled "VACUUM PLATEN FOR AN IMAGE FORMING APPARATUS" in the name of John C. Love and U.S. patent application Ser. No. 12/177,349 filed concurrently herewith entitled "CUTTING STATION FOR AN IMAGE FORMING APPARATUS" in the name of John C. Love, incorporated herein by reference.

FIELD OF THE INVENTION

The present invention relates to a media hold-down device for an image forming apparatus such as printers, plotters, copiers, scanners and facsimile machines. In particular the present invention relates to a device to remove ink mist so that it does not deposit on printer components, or on the front or back side of the media.

BACKGROUND OF THE INVENTION

As one of conventional recording apparatuses, an ink jet recording apparatus is known in which a recording medium is intermittently fed in a recording section. Each time the feed is interrupted, ink droplets are ejected from a recording head over a certain width in a direction perpendicular to the feed direction, thereby recording an image. Unless the spacing between a nozzle surface of a recording head of an ink jet recording apparatus, which ejects ink in a recording section, and a recording medium is maintained to be small with high accuracy, an image is degraded due to a variation in arrival time of ejected ink droplets. If a space is not maintained between the recording head and the medium, a smear occurs due to contact between the recording head and the recording medium and the recording head may be damaged.

In some ink jet recording apparatuses, therefore, a carriage holding a recording head is scanned with high accuracy using a guide shaft of good straightness, and a recording medium is attracted onto a flat platen under a vacuum suction. Generally, in the apparatus using such a suction platen, a vacuum pump, a fan or the like is employed as a negative pressure generating source, and air in an enclosed space below the platen is evacuated to the outside to create a negative pressure in the space (i.e. to provide a pressure that is lower than ambient atmospheric pressure).

Recently, to meet a demand for recording an image without surrounding margins as with a borderless photograph or image, there has been proposed an apparatus in which ink is ejected over a range greater than the width of a recording medium to form a borderless image.

For roll-fed recording media, conventional problems in the recording operation occur at the point where a printed media is to be cut in a cutting zone. Cutting is performed after an image has been printed. In conventional image forming apparatuses, the printed media is only held on one side of the cutter by the vacuum platen or hold-down device. However, this method has drawbacks. When the printed media is cut by the conventional apparatus, it has a tendency to pull away under its own weight and tear as it is cut. This problem adds additional cost as the recorded image must be re-printed wasting material and operator cost and time.

In inkjet printing, image quality is affected by a combination of factors—one of them being the degree of uniformity of the distance between the nozzles on the printhead and the media. It is also important that the media be held down sufficiently well so as to avoid the printhead from touching the media (which ruins the print and can damage the printhead).

SUMMARY OF THE INVENTION

An aspect of the present invention is to provide a media hold-down device as part of an image forming apparatus. By varying the hold-down pressure in response to the extent of coverage of chamber rows by a advancing media to be printed upon, or in response to the extent of coverage of chamber columns by the width of an advancing media, the pressure applied is more appropriate than if it were constant at a level suited to hold down the entire media. In addition, moving the media over a non-chambered zone where cutting may take place, yet allowing the media to be held down under vacuum in chambers beyond the cutting space, facilitates a clean cut. An overprint trough has vent holes in the sloping side walls to suction capture ink mists so as to prevent the mists from landing on the backside of the advancing media by directing the mist away from the backside and through the vent holes. The trough may have a bottom that is sloped to drain liquid ink.

The image forming apparatus may be an ink jet recording apparatus, which can perform high-quality recording without causing a backside ink mist deposits on a recording media even in borderless recording where an image is recorded in full size until reaching lengthwise and widthwise ends of the recording medium with respect to the feed direction.

It is expensive to reprint a recorded image, which may be necessary as a result of a tearing of the print media at the cutting tool. Therefore, such tearing should be avoided in accordance of the invention by holding down media on both sides of a cutting zone through an array and set of chambers. A cutting tool cuts in the cutting zone.

A media hold-down device installed in an image forming apparatus increases the precision for controlling the movement of the printing media through an improved set of vacuum holes formed in a recess of the platen (reference) surface which are in fluid communication with at least one source of negative pressure.

A media hold-down device having a platen and a two-dimensional array of vacuum chambers apply a negative pressure to a media advancing across the platen. For at least part of the length of the platen, the vacuum chambers are arranged in rows one behind the other in the direction of media advance. An advantage of this arrangement is that a satisfactory negative pressure is applied to the media as soon as its leading edge substantially covers all the holes through the platen, which are in communication with the chambers of the first row.

The vacuum platen preferably has a plurality of vacuum chambers that are connected to a source of negative pressure, such that the source of negative pressure is adjustable as a function of how many chambers are covered by media according to a media width or media position along the media advance direction.

According to one feature of the present invention, an image forming apparatus includes a reference surface that is partitioned into an array of chambers; an image forming head for forming an image on a media; and a source of negative pressure. The array of chambers is in fluid communication with the source of negative pressure. An overprint trough is positioned neighboring the array of chambers. The overprint trough includes a side wall with a plurality of vent holes to direct airborne ink mist produced by the image forming head away from a back side of the media.

According to another feature of the present invention, a method of printing includes forming an image on a media using an imaging forming head; and directing airborne ink mist produced by the image forming head away from a back side of the media using an overprint trough including a side wall with a plurality of vent holes located in the side wall.

BRIEF DESCRIPTION OF THE DRAWINGS

Additional aspects of the present invention will become apparent from the following description of the preferred embodiments with reference to the attached drawings.

DETAILED DESCRIPTION OF THE INVENTION

Figure 1:
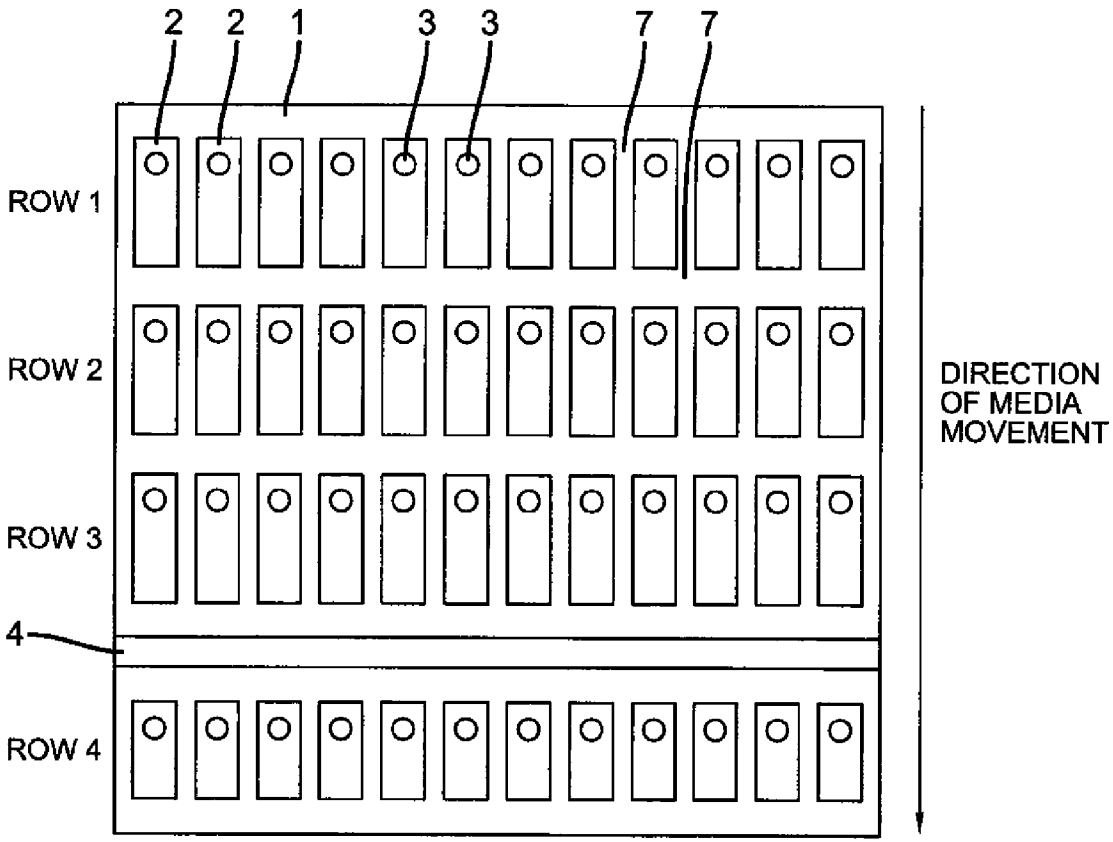
FIG. 1 is a top view of the first embodiment of the present invention.

The following groups of terms shall have the same meaning whether used in the specification or claims of the present invention. The terms trough, borderless printing trough and overprint trough shall have the same meaning. The terms hold-down device and vacuum platen shall have the same meaning. The terms airborne ink mist and ink mist shall have the same meaning. The terms negative pressure, partial vacuum and vacuum shall have the same meaning.

The first embodiment of the instant invention will be described in terms of FIGS. 1-3, 5, 6 and 8. As illustrated, the vacuum platen 1 includes a matrix or array of vacuum chambers 2 which are in fluid communication with at least one source of negative pressure 100 in FIG. 5 via the ports 3.

In this embodiment, there are four rows of vacuum chambers 2, such that the distance from one row to the next row is along the media advance direction. However, any number of rows may be used in the present invention. In addition, there are a number of columns of vacuum chambers 2, such that the distance between one column and the next is perpendicular to the media advance direction.

A preferred width of a vacuum chamber 2 to be compatible with the stiffness of typical wide format media is on the order of 0.3 to 0.4 inch. In one embodiment, the number of columns is 125 columns per row with each column containing a vacuum chamber 2 with a port 3 for a an imaging apparatus having a platen that can accommodate 44" wide format media. However, it is contemplated that more or fewer holes may be used for platens for other imaging apparatuses such as the 12" or 24" format imaging apparatuses. For the 44" wide format platen, this embodiment has a total of 500 vacuum chambers where 4 rows and 125 columns are utilized. A cross-section of two vacuum chambers 2 and their associated plenum and source of negative pressure 100 is schematically shown in FIG. 8.

Figure 8:
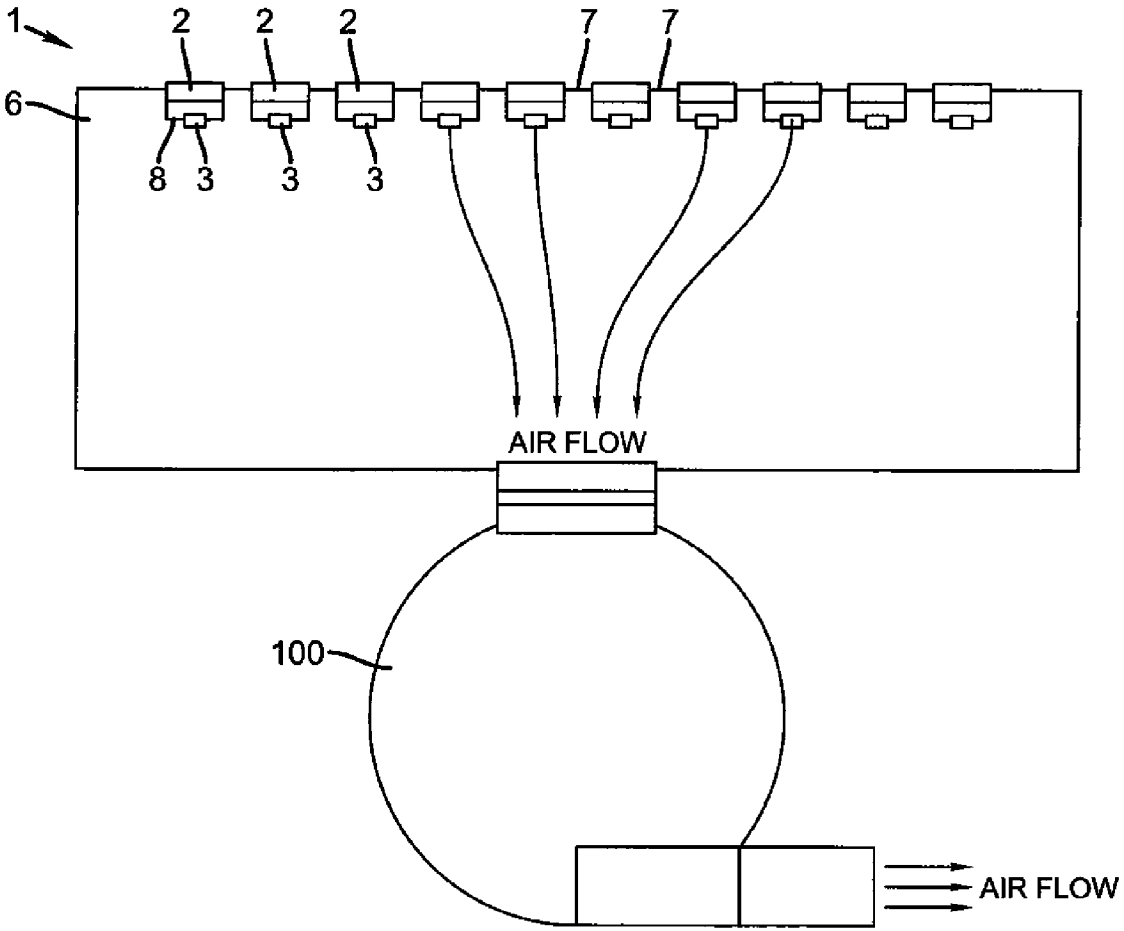
FIG. 8 is a side cross-sectional view of the present invention illustrating one row of vacuum chambers and ports.

In FIG. 8, each vacuum chamber 2 of FIG. 1 further has a plurality of walls 7 surrounding a recess whose base 8 includes a port 3. The port 3 is in fluid communication with the at least one source of negative pressure 100 (FIG. 5) in the range of 0.25 to 3 inches of water as measured at the chamber when the chamber is covered, e.g. by overlying media. In a preferred arrangement, the at least one source of negative pressure may be utilized by each row of chambers. In a preferred arrangement, the illustration of FIG. 8 is repeated for each row of chambers. Each row of chambers may be in fluid communication with a different source of negative pressure that may provide a different level of pressure for each row of vacuum chambers. Further, the at least one source of negative pressure is connected to a plenum 6 in FIG. 8. For the example of a single source of negative pressure, all of the chambers in the platen will be connected to a single plenum 6. For an alternate embodiment such that a first group of chambers (for example a first row of chambers) is independently connected to a first source of negative pressure, and a second group of chambers (for example a second row of chambers) is independently connected to a second source of negative pressure, there will be a first plenum between the first source of negative pressure and the first group of chambers, and there will be a second plenum between the second source of negative pressure and the second group of chambers. Alternatively, multiple different negative pressure sources can be connected to a single plenum and selectively turned on or off to provided different levels of negative pressure to all the chambers.

The plenum 6 is a large volume plenum, which provides a uniform negative pressure to all ports at a given time, regardless of the number of ports that are covered by media. The magnitude of the negative pressure applied to each port depends upon the negative pressure source, as well as upon the number of ports that are covered, e.g. by media. The large volume and the lack of internal flow restriction allow the pressure to equalize rapidly within the plenum. The vacuum platen further comprises a cutting zone 4 installed with a cutter (not shown). The preferred cutter is a "pizza wheel" or rotatable blade type cutter with a fixed blade in the vacuum platen 1 and a rotatable blade attached to a printer carriage (not shown). However, a knife type cutter or a laser cutter could be used with similar benefits. Those of ordinary skill in the art would realize that other type of cutters may be used in conjunction with the present invention without departing from the scope of the invention The ports 3 may be any shape or size. However, the range of sizes includes 0.5 mm to 3 mm in diameter with a preferred size of 1.5 mm in diameter. The optimum port diameter for the vacuum platen is dependent upon the flow rate of the vacuum source, the number of chambers/ports and the range of media widths to be accommodated. The shape of the ports 3 may be circular or polygonal. The preferred shape of the ports 3 is circular.

The vacuum platen 1 is preferably constructed of injection-molded plastic. Plastic platen pieces have the advantage of providing complex geometries at low cost and when attached to a flat, rigid reference provides adequate flatness. Other constructions, such as ceramics and other synthetic materials, may be used as long as they are compatible with the chemicals in the printer inks and provide for the required geometries, friction properties, and flatness criteria. A preferred plastic is GE Noryl™ which has been found to have a superior compatibility with the inks of the present invention.

Figure 2:
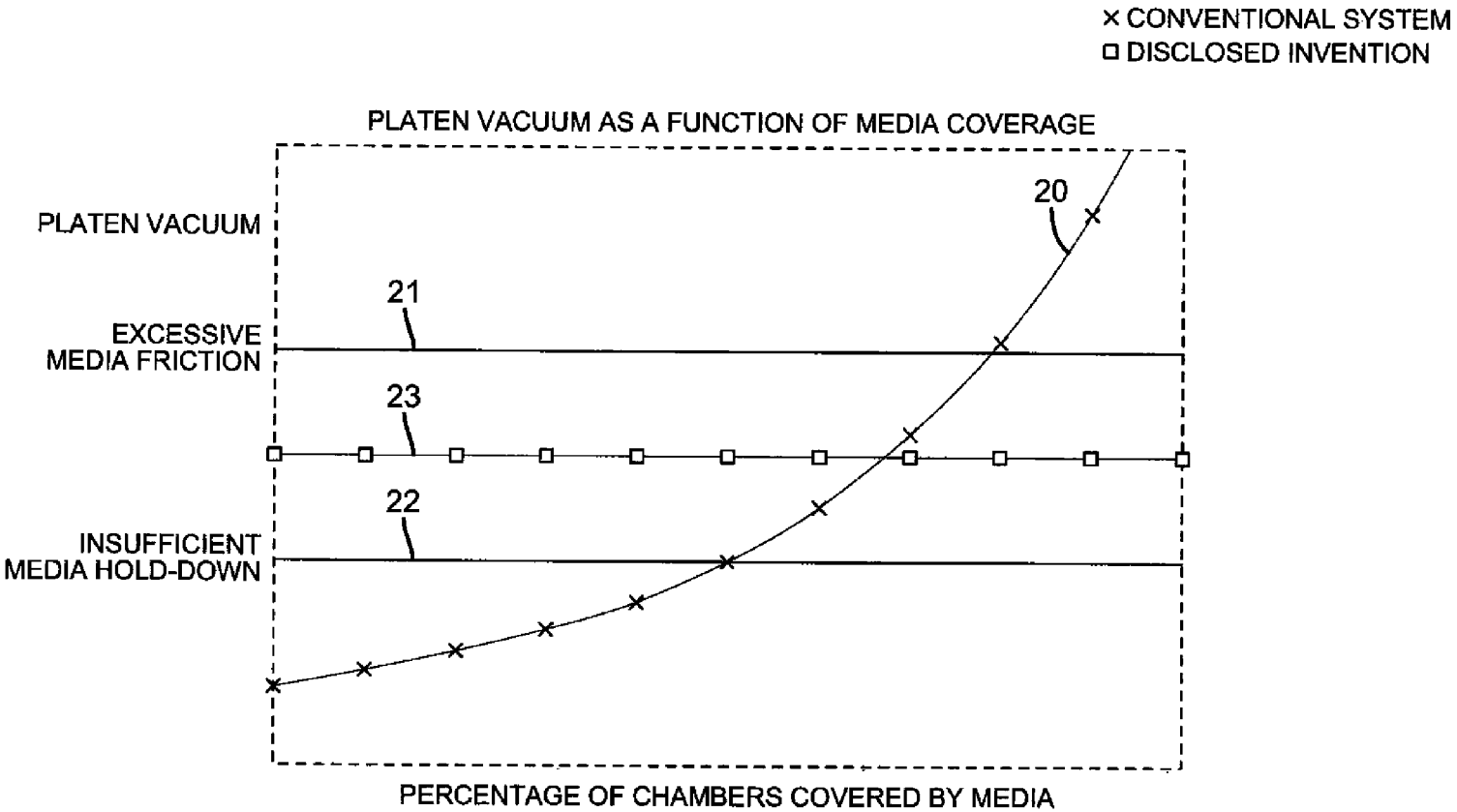
FIG. 2 is a graph that schematically represents platen vacuum as a function of media coverage of the chambers for the present invention as compared to a conventional system.

One goal of the present invention is to provide a relatively constant pressure in each of the chambers that are covered with media, regardless of how many chambers are covered, as illustrated in FIG. 2. If there are many chambers that are not covered when narrow media is loaded, it is difficult to pull the media down to close the chamber due to air leakage at the uncovered chambers. In other words, there is a minimum level 22 of platen vacuum that is needed in order to provide sufficient hold-down force on the media. As the number of covered chambers increases, the amount of air leakage decreases and the platen vacuum level increases in a conventional system, as illustrated by the curve 20. At too high a vacuum level (greater than platen vacuum level 21), the friction between the platen and the advancing media becomes excessive. As illustrated by curve 20, the conventional system provides too little hold-down force when the chambers are minimally covered (as for example when media begins to cover a long chamber, and especially for narrow media), and it provides too much hold down force resulting in excessive friction when the chambers are extensively covered (as for example when media completely covers the long chambers, and especially for wide media). The platen vacuum level provided as a function of the percentage of chambers covered by media for the present invention is shown by the idealized level 23, which is between levels 21 and 22. Note that it is not necessary to provide a constant vacuum level 23, but just that the vacuum level remains between levels 21 and 22.

The vacuum platen 1 is fluid communication with at least one fan, vacuum pump or other negative pressure source 100 in FIG. 8. By such fluid communication, it is meant herein that the chambers of the vacuum platen are connected to the source of negative pressure, so that air may be drawn by the source of negative pressure through the ports of the chambers to provide suction at the chambers. Further, the fan or other negative pressure source 100 may be in communication with at least one negative pressure source controller 101 in FIG. 6. For the case where the negative pressure source is a fan, the fan controller 101 in FIG. 6 controls the electrical energy applied to the fan by varying the fan voltage and/or the pulse-width or duty cycle of the applied electrical power, which changes the fan speed (and hence the amount of airflow), or switches to a different fan, or turns on a plurality of fans, for example, in order to vary the negative pressure, based on a media width, or media type, or position in the media advance direction as provided by an input from media sensing subsystem 81. The term "adjust" is used herein to describe any of these exemplary methods (varying the energy applied to the negative pressure source, activating a different negative pressure source, or activating additional negative pressure sources) or others known to those skilled in the art for varying the negative pressure. Media sensing subsystem 81 is meant herein to include any means of providing information regarding the position, type or width of the media. For example, it can include an optical or mechanical sensor that detects an edge of the media; it can include an encoder that is coupled to media advance rollers (that are part of media advance subsystem 82 controlled by media advance controller 80) to determine media advance position; it can include media type detection; it can include user input to indicate media type or width; it can include a vacuum sensor connected at the plenum 6, for example; etc. While media position and media width are indicative of the number of chambers that are overlaid by the media, media type may be indicative of media stiffness, friction, etc.

Figure 3A:
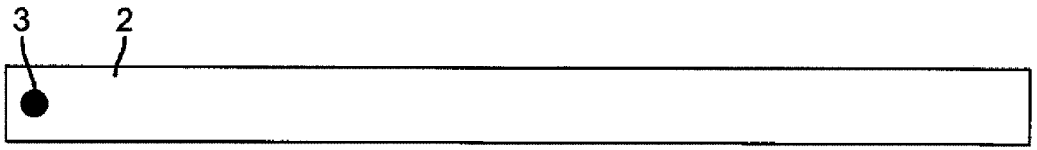
FIG. 3A (PRIOR ART)
FIG. 3*a* is a top view of a long chamber of a conventional vacuum platen.
Figure 3B:
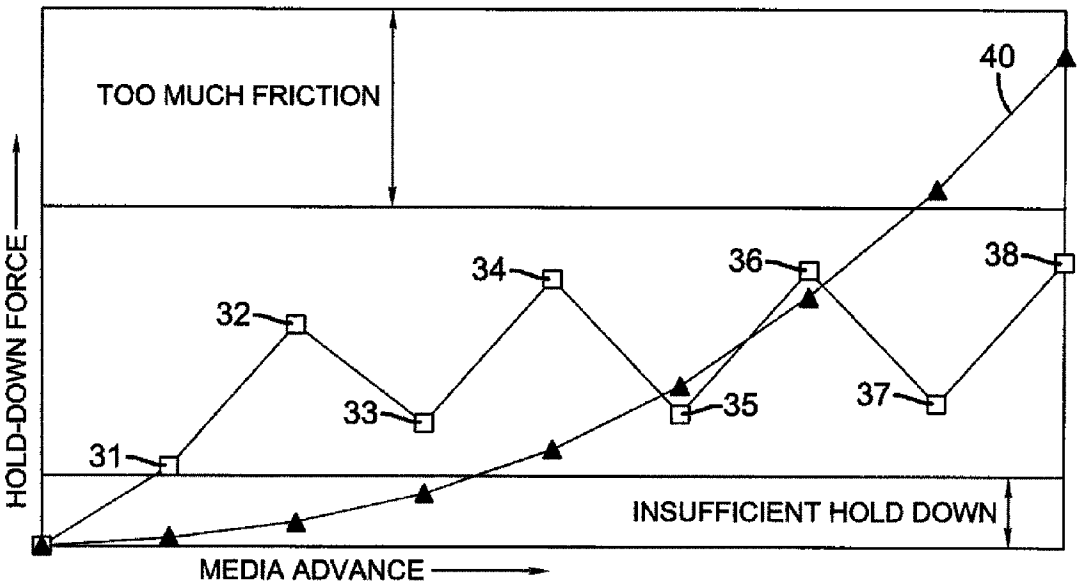
FIG. 3*b* is a graph that schematically represents media hold down force provided by the present invention as compared to a conventional system.
Figure 3C:
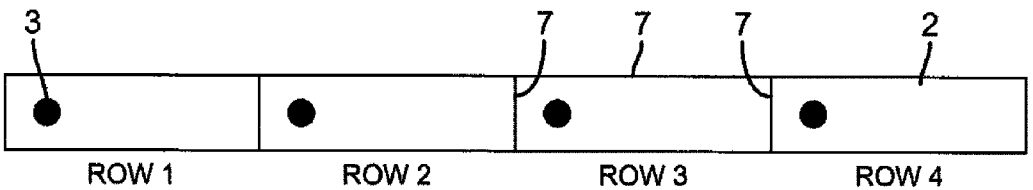
FIG. 3*c* is a top view of a single column of four rows of chambers of the present invention (rotated 90 degrees relative to FIG. 1)

FIGS. 3*a-c* illustrate schematically the hold-down force that is provided by the vacuum platen 1 to a recording medium as a function of media advance. FIG. 3*a* shows a top view of one vacuum chamber 2 in a row of conventional chambers, where the platen consists of a single row of long vacuum chambers. FIG. 3*c* shows a top view corresponding to one column of vacuum chambers 2 of FIG. 1 (rotated 90 degrees from the orientation of FIG. 1), but without explicitly showing the cutting zone. FIG. 3*b* shows hold down force versus media advance relative to media position relative to the chambers of FIG. 3*a* and FIG. 3*c*. Curve 40 (corresponding to platen vacuum curve 20 of FIG. 2) represents the hold-down force for a conventional vacuum platen with a non-adjustable source of negative pressure. Note that the hold-down force for the conventional vacuum platen represented by curve 40 is too small for media hold down as the media advances from left to right. Even though the port 3 may be covered by media, if the media is not covering the walls of the chamber, there are still air leakage paths. As the media continues to advance, resistance to air leaking increases and the hold-down force increases. When the media covers long chamber 2 extensively, the hold-down force in curve 40 is too large and results in excess friction between the media and the platen.

The square data points in FIG. 3*b* are intended to schematically represent the hold-down force provided by a vacuum platen according to an embodiment of the present invention. At the far left the media has not advanced past the leftmost wall of the chambers in Row 1, so there is no hold-down force. Optionally in this range, the media sensing subsystem 81 can indicate to the negative pressure source controller 101 that no media is present in the platen region, and controller 101 does not turn on negative pressure source 100. When the media has advanced partway across row 1 of chambers (corresponding to data point 31 in FIG. 3*b*), there is some air leakage in the chambers of row 1, but negative pressure source 100 is adjusted to a level that provides sufficient hold-down force. When the media has advanced to cover row 1 completely, there is significantly less air leakage in the chambers of row 1 and the hold-down force rises as indicated by data point 32, but still is within the acceptable range. As the media is advanced into row 2 of chambers, if the negative pressure source 100 is not adjusted the hold-down force would continue to rise. However, according to embodiments of this invention, the energy applied to the negative pressure source 100 is reduced, or a different negative pressure source is turned on, or fewer negative pressure sources are turned on, so that the hold-down force stays within the acceptable range at data point 33. As the media advances across row 2 of chambers, the hold-down force increases to data point 34, but stays within the acceptable range. As the media continues to advance, the negative pressure source 100 continues to be adjusted to keep the hold-down force within the acceptable range as indicated by data points 35, 36, 37 and 38. The example described here illustrates the provision of a range of suitable hold-down forces as the media covers a greater percentage of chambers in the media advance direction for a particular media width. When a different media width is sensed by media sensing subsystem 81 (i.e. a different number of columns of chambers are overlaid by media), the negative pressure source 100 is adjusted to provide a suitable range of hold-down forces for that media width.

Figure 4:
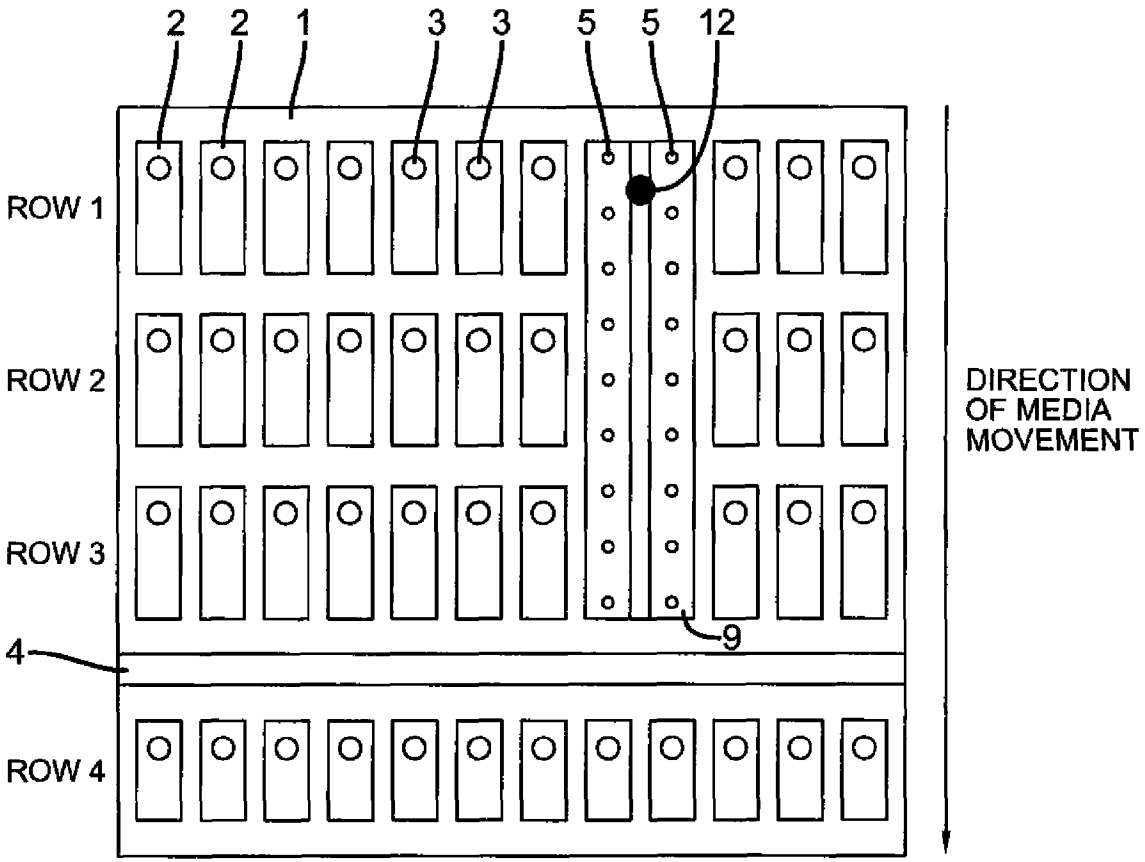
FIG. 4 is a top view of the second embodiment of the present invention.
Figure 5:
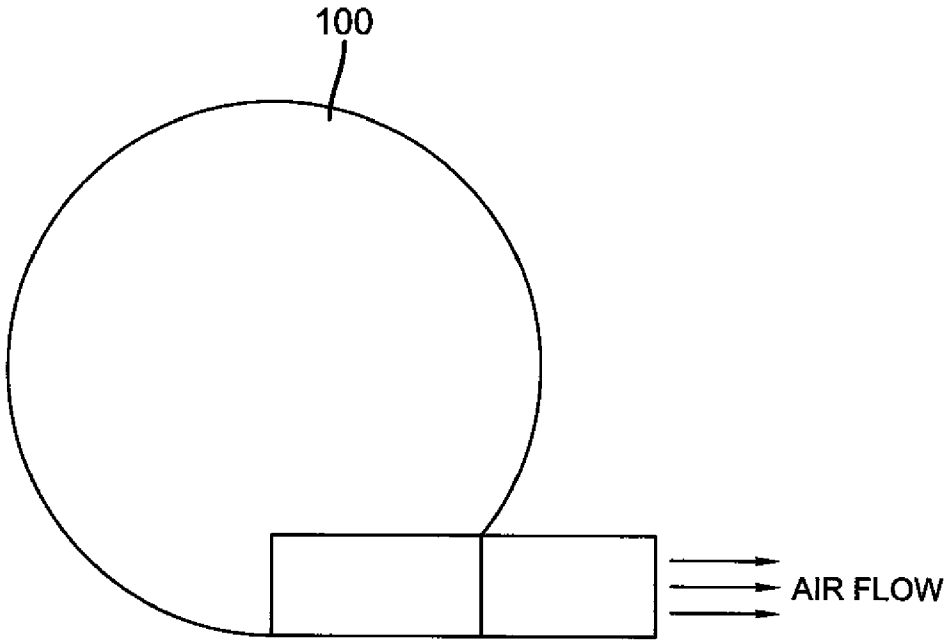
FIG. 5 is a schematic side view of a negative pressure source of the present invention.
Figure 6:
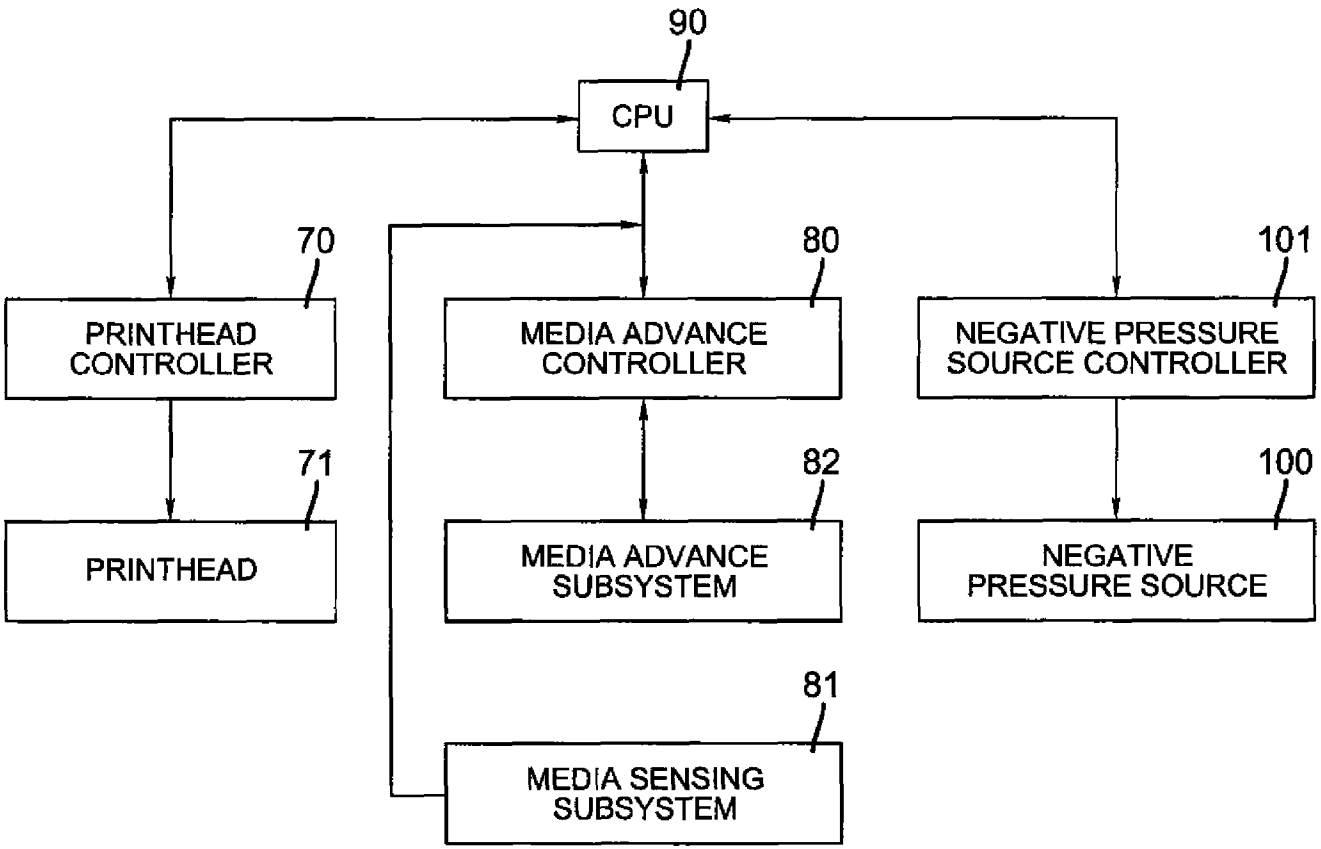
FIG. 6 is block diagram of some of the electronic control components of the present invention.
Figure 7:
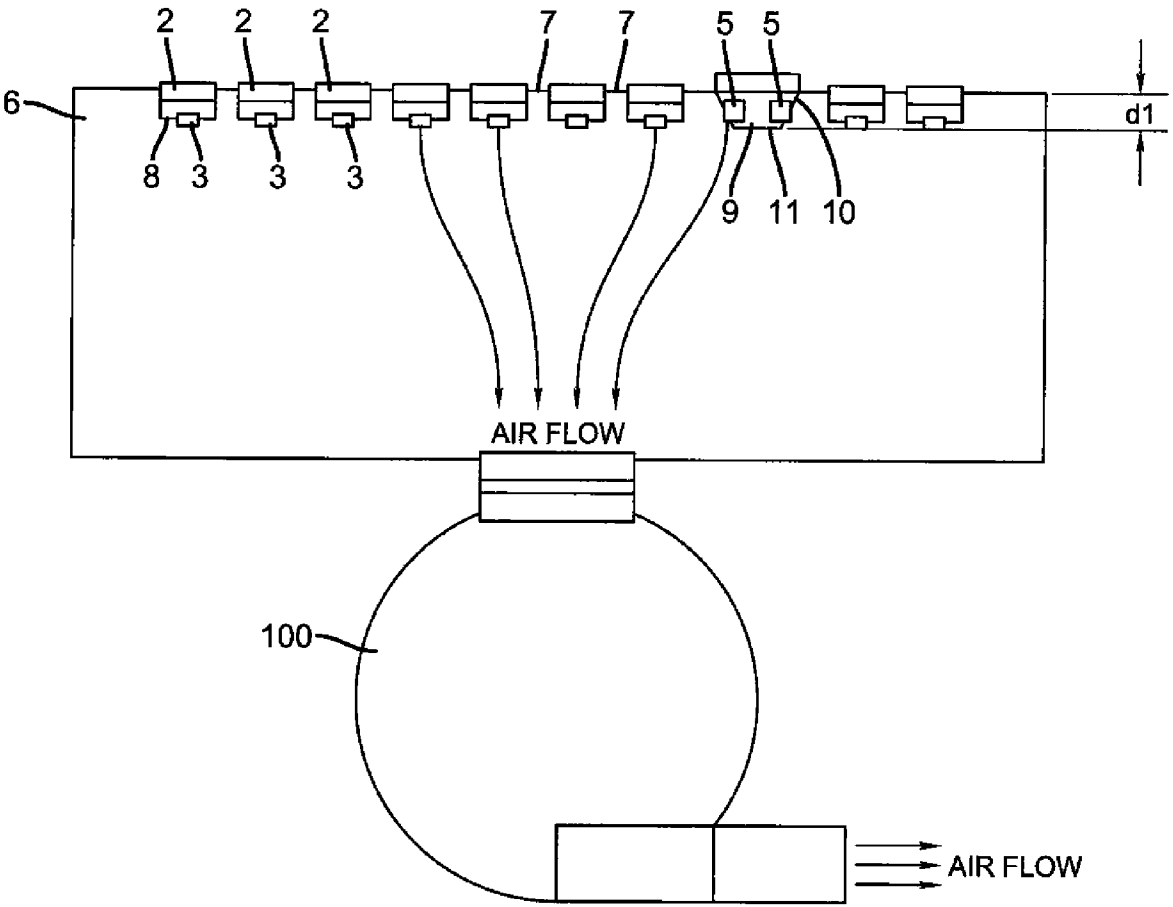
FIG. 7 is a side cross-sectional view of the present invention illustrating one row of vacuum chambers and ports plus an overprint trough and vent holes.

FIG. 4 is the second embodiment of the present invention, which is primarily directed for use in an ink jet printer with an ink jet printhead. However, various other image forming apparatuses may be used as are known to those skilled in the art. It is noted that this embodiment includes all the features enumerated in reference to the first embodiment in FIGS. 1-3, 5-6 and 8 plus additional features discussed below. Similar parts are described as similar reference numerals with regard to the first embodiment of the present invention. Additionally, the second embodiment features a borderless printing trough or overprint trough as indicated in FIG. 4. The borderless printing trough 9 in FIG. 7 is comprised of a plurality of vent holes 5 which are smaller in diameter than the diameter of the ports 3. The vent holes 5 are more densely populated than the ports 3. The vent holes 5 are in the sloping side walls 10 of the borderless printing trough 9. The sloping walls converge to a central drain channel in a bottom wall 11, which in turn may be sloped to drain out through a bottom opening 12.

In the prior art (for example, U.S. Pat. No. 6,575,554), all holes in the overprint trough or ink recovery section are positioned in the bottom wall and are connected to the source of negative pressure. Thus all droplets that are ejected beyond the media edge during borderless printing, as well as the associated ink mist, are drawn into the airstream passage of the negative pressure source where they collect in various regions so that additional ink absorbers need to be inserted in the airstream passage. By contrast, in a preferred embodiment of the present invention, the ink droplets that land beyond the edge of the media during borderless printing are able to accumulate and flow to the bottom wall 11 of the overprint trough 9, and then drain out through bottom opening 12 that is not connected to the negative pressure source. It has been found advantageously that for the present invention, the ink mist that is drawn into the negative pressure source through the vent holes 5 in the side walls 10 do not result in substantial ink residue build-up over the life of the printing system and do not require ink absorbers or ink filters in the airstream or elsewhere in the negative pressure source.

In an alternative embodiment (not shown), the side walls 10 of the borderless printing trough 9 may be perpendicular to the bottom wall 11, rather than sloping. In general, preferably one set of vent holes 5 is in one side wall 10 and another set of vent holes is in a different side wall 10 of the borderless printing trough 9.

In FIG. 4, the left (or right) media edge (not shown) would nominally travel above the central region of the trough 9 during advance of the media. Due to system tolerances, to ensure printing occurs all the way to the edge, a portion of ink must be printed past the edge—this is called overprint. Due to the size of the ink drops being printed and to inkjet technology in general, as this overprint travels into the trough, some of it becomes mist at zero velocity. Not all of it makes it to the trough 9 as liquid, which drains out through the bottom of the trough.

This ink mist will travel where air currents take it, and could settle, or deposit, in an undesirable location on the printer or media, as is well known in the art. In a partial-vacuum platen system, the media is held down against the platen using negative pressure (with a small amount of flow—not a perfect vacuum). Because the media and the platen do not create an air-tight seal, there is always some flow of air underneath the media into the covered partial-vacuum chambers. Because the area of this flow is very small, the velocity of its stream is high.

During borderless printing, this high velocity stream of air pulls the suspended ink mist (described above) underneath the media, where it deposits near the edge. The back of a finished print will have a noticeable and undesirable line of ink near the edge along the length of the print. In order to avoid this issue, the ink mist needs to be diverted from traveling underneath the media.

In accordance with the invention, having a series of small vent holes 5 (smaller than the ports 3 in each regular chamber 2) along the printing area length creates a dominant, high velocity flow path. This air stream, instead of the air stream that travels underneath the media, draws the ink mist away—thus, not allowing ink to deposit on the backside of the media. The preferred number of vent holes 5 per trough is around 20 with a preferred diameter of vent holes 5 of 1 mm. The diameter of the vent holes 5 is in the range of 0.2 mm to 2 mm, although low-cost manufacturing considerations may make the range 0.5 mm to 2 mm to be preferable. Additionally, other numbers of vent holes in the overprint trough 9 may be utilized as those skilled in the art will recognize. The depth d1 of the overprint trough 9 in FIG. 7 is in the range of 2 mm to 5 mm with a preferred depth of 4 mm. These depths allow a larger percentage of the ink to become aerosol so it can be carried away without being deposited on backside of the printed media. The media is preferably held against a reference surface (platen) by means of a partial-vacuum. It is the reference surface that controls (in part) the absolute distance and the variation of the distance over the printing surface area. There are benefits from having a partial-vacuum zone after the cut channel on the platen, as well as, while doing borderless printing. The partial-vacuum may be created using a blower fan with its inlet attached to a larger plenum. Multiple platen pieces are attached to this plenum, thus providing a common negative pressure source. Each chamber on each platen piece is connected to this common negative pressure source. The flow output of the fan is restricted by the small chamber holes, thus creating a negative pressure (partial vacuum) in the plenum and platen. Multiple fans may be used to achieve a greater negative pressure or to add the ability to vary the negative pressure applied. The voltage or duty cycle of the fan(s) may also be varied (within usable limits) to control the negative pressure by way of a fan controller or general purpose controller or CPU. There are multiple chambers across the width of the platen. This is done to (1) accommodate multiple widths of media, (2) control the hold-down at the edge of the media, and (3) keep the media from diving down into the chamber and getting jammed or caught. By having closed chambers across the width, there is not a flow path out from underneath the media on the sides that causes a drop in negative pressure at the edges.

The invention has been described in detail with particular reference to certain preferred embodiments thereof, but it will be understood that variations and modifications can be effected within the scope of the invention.

PARTS LIST

1 Vacuum hold-down device/reference plane
2 Vacuum chambers
3 Vacuum chamber ports
4 Cutting zone
5 Overprint trough vent holes
6 Plenum
7 Walls of vacuum chamber
8 Base of vacuum chamber
9 Overprint ink tough
10 Side wall of overprint ink trough
11 Bottom wall of overprint ink trough
12 Drain opening of overprint ink trough
20 Platen vacuum as function of media coverage for conventional system

21 Maximum platen vacuum for acceptable friction on media
22 Minimum platen vacuum providing sufficient media hold-down
23 Platen vacuum as function of media coverage for present invention
31-38 Hold-down force for present invention
40 Hold-down force for conventional system
70 Printhead controller
71 Printhead
80 Media advance controller
81 Media sensing subsystem
82 Media advance subsystem
90 CPU
100 Negative pressure source
101 Negative pressure source controller

What is claimed is:

1. An image forming apparatus comprising:
a reference surface that is partitioned into an array of chambers;
an image forming head for forming an image on a media;
a source of negative pressure; the array of chambers being in fluid communication with the source of negative pressure; and
an overprint trough including a side wall and a plurality of vent holes, the plurality of vent holes being located in the side wall to direct airborne ink mist produced by the image forming head away from a back side of the media, the overprint trough being positioned neighboring the array of chambers.

2. The image forming apparatus of claim 1, the side wall of the overprint trough being a first side wall, the plurality of vent holes being a first plurality of vent holes, the overprint trough further comprising a second side wall with a second plurality of vent holes.

3. The image forming apparatus of claim 1, further comprising:
a source of negative pressure in fluid communication with the plurality of vent holes, wherein the source of negative pressure in fluid communication with the plurality of vent holes and the source of negative pressure in fluid communication with the array of chambers are the same source of negative pressure.

4. The image forming apparatus of claim 1, wherein the image forming head is an inkjet printhead.

5. The image forming apparatus of claim 1, wherein a depth of the trough is in a range of 2 mm to 5 mm from the reference surface.

6. The image forming apparatus of claim 1, the overprint trough including a bottom wall, the bottom wall including a drain hole.

7. The image forming apparatus of claim 6, wherein the bottom wall is sloped to direct fluid toward the drain hole.

8. The image forming apparatus of claim 6, wherein the drain hole is not connected to a source of negative pressure.

9. The image forming apparatus of claim 1, the overprint trough including a drain, wherein the side wall is sloped to direct fluid toward the drain.

10. The image forming apparatus of claim 1, at least one chamber of the array of chambers including a port, wherein a cross sectional area of one of the plurality of vent holes is smaller then a cross sectional area of the port.

11. The image forming apparatus of claim 1, wherein the side wall is sloped.

12. The image forming apparatus of claim 1, the overprint trough including a bottom wall, wherein the side wall is perpendicular relative to the bottom wall.

13. The image forming apparatus of claim 1, wherein the overprint trough does not include an ink absorber.

14. A method of printing comprising:
forming an image on a media having an edge using an imaging forming head by directing ink droplets to the media and to a region beyond the edge of the media; and
directing airborne ink mist produced during image formation by the image forming head away from a back side of the media using an overprint trough including a side wall with a plurality of vent holes located in the side wall.

15. The method of claim 14, wherein directing airborne ink mist produced by the image forming head away from a back side of the media including using a source of negative pressure connected to the plurality of vents holes in the side wall of the overprint trough.

16. An image forming apparatus comprising:
a reference surface that is partitioned into an array of chambers, each chamber including a port;
an image forming head for forming an image on a media;
a source of negative pressure; the ports located in the array of chambers being in fluid communication with the source of negative pressure; and
an overprint trough positioned neighboring the array of chambers, the overprint trough including a side wall and a plurality of vent holes located in the side wall to direct airborne ink mist produced by the image forming head away from a back side of the media, the plurality of vent holes being in fluid communication with the source of negative pressure, the plurality of vent holes being smaller than the port located in each chamber such that a higher velocity flow path is created through the plurality of vent holes when compared to a flow path created through the port located in each chamber.

17. The image forming apparatus of claim 16, wherein the side wall is sloped.

18. The image forming apparatus of claim 16, the overprint trough including a bottom wall, wherein the side wall is perpendicular relative to the bottom wall.

* * * * *